US007772475B2

(12) United States Patent
Nakata

(10) Patent No.: US 7,772,475 B2
(45) Date of Patent: Aug. 10, 2010

(54) ELECTRONIC MUSICAL INSTRUMENT

(75) Inventor: Takuya Nakata, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/104,806

(22) Filed: Apr. 17, 2008

(65) Prior Publication Data

US 2008/0257131 A1 Oct. 23, 2008

(30) Foreign Application Priority Data

Apr. 17, 2007 (JP) ..... 2007-107752

(51) Int. Cl.
*G10C 3/12* (2006.01)

(52) U.S. Cl. ..... 84/426; 84/225

(58) Field of Classification Search ..... 84/426, 84/225; D17/5, 7
See application file for complete search history.

(56) References Cited

U.S. PATENT DOCUMENTS 4,632,349 A * 12/1986 Anstey ..... 248/281.11
6,673,991 B2 * 1/2004 Hara ..... 84/179
7,086,632 B2 8/2006 Hsieh
2003/0029299 A1 * 2/2003 Yoshida ..... 84/327
2007/0017337 A1 1/2007 Sugimoto et al.
2008/0276788 A1 11/2008 Nakata

FOREIGN PATENT DOCUMENTS

JP 1-43756 Y2 12/1989
JP 6-21092 U 3/1994
JP 2007-25442 A 2/2007
JP 2007047689 A * 2/2007

* cited by examiner

*Primary Examiner*—Jianchun Qin
(74) *Attorney, Agent, or Firm*—Rossi, Kimms & McDowell LLP

(57) ABSTRACT

A main body 10 having a keyboard operated with player's hands is supported on both sides thereof by stand portions 22, 24. To the lower end of the stand portions 22, 24, a fixed unit 52 is fixed. On the fixed unit 52, a moving unit 60 is mounted so that the moving unit 60 can move frontward and backward. On the moving unit 60, a pedal 62 operated with a player's foot is mounted. Separately from the keyboard operated with the hands, as a result, the player is allowed to adjust his desired front-back directional position of the pedal 62.

6 Claims, 11 Drawing Sheets

ELECTRONIC MUSICAL INSTRUMENT

This application is based on, and claims priority from, Japanese Patent Application No: 2007-107752, filed on Apr. 17, 2007. The disclosure of the priority application, in its entirety, including the drawings, claims, and the specification thereof, is incorporated herein by reference.

BACKGROUND OF THE INVENTION

1. Field of the Invention

The present invention relates to an electronic musical instrument such as an electronic piano and an electronic organ.

2. Description of the Related Art

Electronic keyboard instruments such as an electronic piano and an electronic organ are played by users of various physiques from adults to children. Therefore, there have been electronic keyboard instruments which allow users to adjust dimensions of the instruments according to physique of the users. For instance, Japanese Unexamined Utility Model Publication No. 6-21092 discloses an electronic keyboard instrument having a pedal unit including a pedal keyboard or the like, the electronic keyboard instrument allowing upward and downward adjustment of the mounted position of the pedal unit. Furthermore, Japanese Examined Utility Model Publication No. 1-43756 discloses an electronic keyboard instrument which allows upward and downward or diagonally upward and downward adjustment of the position of a keyboard portion.

DISCLOSURE OF THE INVENTION

Problem to Be Solved by the Invention

However, the above-described conventional arts cannot allow the users to freely adjust the position of the "keyboard portion" and the "pedal portion" in a front-back direction. In the latter prior art disclosed above, for instance, because the height of the "keyboard portion" determines the front-back directional position of the "keyboard portion" together with the front-back directional position of the "pedal portion", the users are not allowed to separately adjust the front-back directional position of the "keyboard portion" and the "pedal portion" as desired. Therefore, the users cannot freely set the front-back directional space between the position of their hands which depress keys and the position of their feet which depress pedals in order to suit their own physique, resulting in possibility of forcing the users to play the keyboard instrument with uncomfortable posture.

The present invention was accomplished to solve the above-described problem, and an object thereof is to provide an electronic musical instrument which increases flexibility in users' posture as well as suits users of various physiques.

Means for Solving Problem

In order to solve the above-described problem, an electronic musical instrument according to the present invention is provided with a stand portion for supporting a main body on both sides thereof, the main body having a keyboard operated with player's hands; a fixed unit fixed to a lower end of the stand portion; and a moving unit equipped with a pedal operated with a player's foot, the moving unit being mounted on the fixed unit so that the moving unit can move frontward and backward.

Furthermore, the electronic musical instrument may be further provided with a restricting mechanism for allowing the moving unit to move frontward with respect to the fixed unit but prohibiting the moving unit from moving backward with respect to the fixed unit while an operating member is not operated, and allowing the moving unit to move both frontward and backward with respect to the fixed unit while the operating member is operated.

Furthermore, the electronic musical instrument may be further provided with a restricting mechanism for prohibiting the moving unit from moving both frontward and backward with respect to the fixed unit while an operating member is not operated, and allowing the moving unit to move both frontward and backward with respect to the fixed unit while the operating member is operated.

Furthermore, the stand portion may be configured by a lower stand portion to which the fixed unit is fixed and an upper stand portion which supports the main body; and the upper stand portion may be mounted on the lower stand portion so that the upper stand portion can move upward and downward.

Effect of the Invention

According to the present invention, separately from the keyboard operated with the hands, the player is allowed to adjust his desired front-back directional position of the pedal which is operated with the player's foot. As a result, the user is allowed to freely set the front-back directional space between the position of their hands which depress keys and the position of their feet which depress pedals in order to suit his own physique, resulting in performance with comfortable posture.

DESCRIPTION OF THE PREFERRED EMBODIMENT

1. First Embodiment

1.1 General Configuration

Figure 1B:
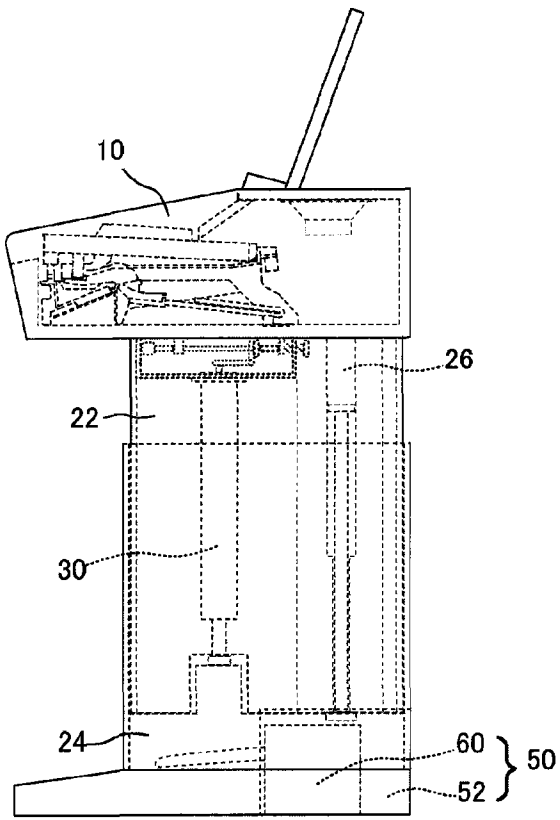
FIG. 1A and FIG. 1B are side views of an electronic keyboard instrument according to a first embodiment of the present invention.
Figure 1A:
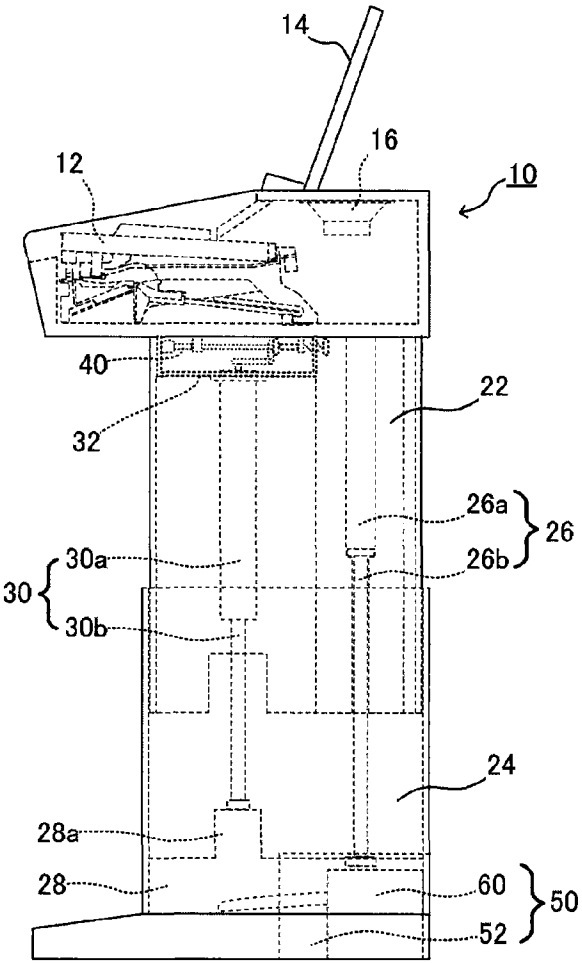

A general configuration of an electronic keyboard instrument (electronic piano) according to a first embodiment of the present invention will be described with reference to FIG. 1A. A main body 10 has a keyboard 12 which is operated by hands, a music stand 14, a speaker 16 and various kinds of electric circuits,(not shown). Upper stand portions 22 are provided on both sides of the main body 10 to form a pair. Each of the upper stand portions 22 is formed like a tube having an approximately rectangular cross-section. The top end of the respective upper stand portions 22 is fixed to the undersurface of the main body 10. Lower stand portions 24 are provided on both sides of the main body 10 in a pair similarly to the upper stand portions 22. Each of the lower stand portions 24 is formed like a tube having an approximately rectangular cross-section which is slightly larger than that of the upper stand portions 22. The upper stand portions 22 are allowed to be inserted into the top end of the lower stand portions 24.

At the lower part of the inside of the respective lower stand portions 24 of both sides, a base 28 having an approximately convex shape is provided. In FIG. 1A, however, the upper and lower stand portions 22, 24 of the right side and the base 28 provided for the lower stand portions 24 of the right side are shown. Between the main body 10 and the base 28, a gas cylinder 30 and a guide portion 26 are provided. The gas cylinder 30 is formed of an approximately tubular cylinder portion 30*a* and an approximately cylindrical piston portion 30*b* jutting downward from the cylinder portion 30*a*. In the gas cylinder 30, the piston portion 30*b* is continuously urged by inner gas pressure of the cylinder portion 30*a* to protrude from the cylinder portion 30*a*. The gas cylinder 30 allows move of gas contained in the cylinder portion 30*a* during depression of a later-described gas control pin 30*d*, so that the piston portion 30*b* can get into or out of the cylinder portion 30*a*. As a result, more specifically, the length of the gas cylinder 30 is variable. If the depression of the gas control pin 30*d* is released, the gas cylinder 30 prohibits move of the gas contained in the cylinder portion 30*a* to prohibit relative move of the piston portion 30*b* with respect to the cylinder portion 30*a*. The guide portion 26 is formed of an approximately tubular guide cylinder 26*a* and a guide piston 26*b* which is allowed to be inserted into the guide cylinder 26*a*. A gas cylinder operating portion 40 is fixed to the undersurface of the main body 10 in order to expand or contract the gas cylinder 30.

A flange portion 32 is formed by bending the front and the rear of a flat plate upward, respectively. More specifically, an aperture of the flange portion 32 points upward to be fixed to the undersurface of the main body 10. The top end of the guide cylinder 26*a* is fixed to the undersurface of the main body 10. The bottom end of the guide piston 26*b* is fixed to the base 28. The bottom end of the piston portion 30*b* of the gas cylinder 30 is fixed to a convex portion 28*a* of the base 28, while the top end of the cylinder portion 30*a* is fixed to the flange portion 32. Although FIGS. 1A, 1B show only the gas cylinder 30 and the guide portion 26 provided on the right side of the electronic keyboard instrument, a similarly configured gas cylinder and a similarly configured guide portion are provided on the left side as well.

Figure 3A:
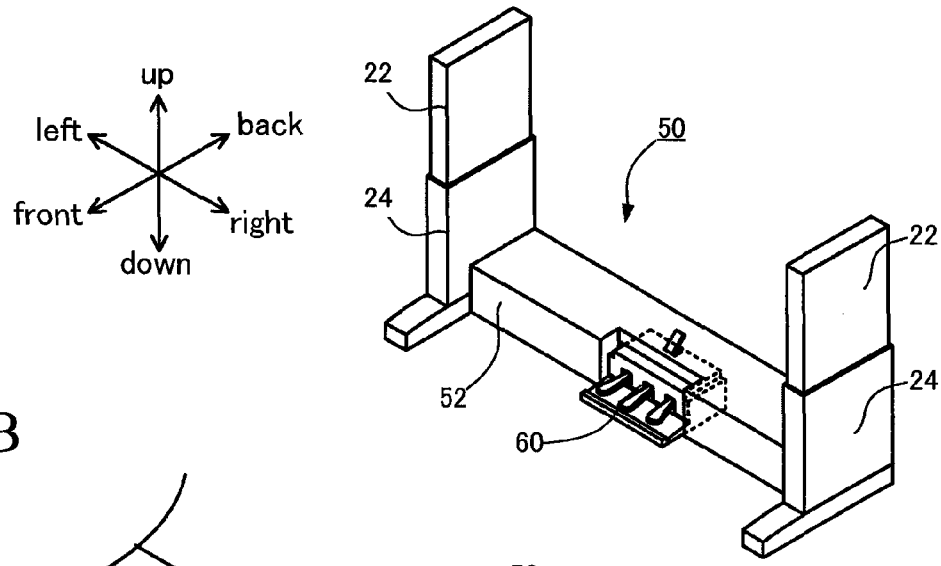
FIG. 3A and FIG. 3B are perspective views of a pedal unit 50 employed in the first embodiment.

A pedal unit 50 is equipped with various kinds of pedals. The pedal unit 50 is formed of a fixed unit 52 which is fixed to the lower stand portion 24 with an L-shaped angle or the like which is not shown, and a moving unit 60 which can move frontward and backward with respect to the fixed unit 52. If the gas cylinder operating portion 40 is operated to lower the main body 10 with the moving unit 60 of the pedal unit 50 being slightly moved frontward, the right side of the electronic keyboard instrument is seen as shown in FIG. 1B. The arrangement of the upper and lower stand portions 22, 24 of the both sides and the pedal unit 50 is shown in FIG. 3A.

1.2 Detailed Configuration of Gas Cylinder Operating Portion 40

Figure 2A:
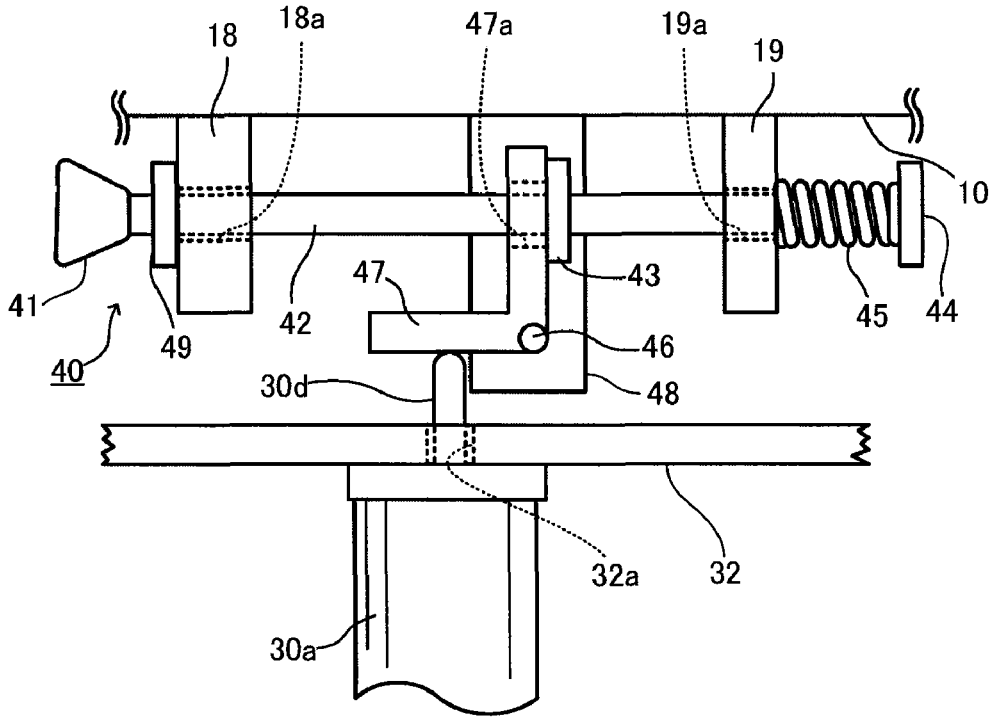
FIG. 2A and FIG. 2B are side views showing detailed configuration of a gas cylinder operating portion 40.

Detailed configuration of the gas cylinder operating portion 40 and the top end of the gas cylinder 30 will be given. In FIG. 2A, supporting members 18, 19 are formed to be shaped like an approximately rectangular plate. The supporting members 18, 19 jut from an approximately central portion in the horizontal direction of the undersurface of the main body 10. On the supporting members 18, 19, circular penetrating holes 18*a*, 19*a* are provided, respectively, the penetrating holes 18*a*, 19*a* penetrating in the thickness direction (in the horizontal direction in the figure). A lever 42 is formed of an approximately long cylindrical metal rod, and is supported by the supporting members 18, 19. The lever 42 penetrates through the penetrating holes 18*a*, 19*a* so that the lever 42 can move frontward and backward with respect to the main body of the musical instrument (in the horizontal direction in the figure).

To the front end (the left end in the figure) of the lever 42, a knob 41 held by a user is fastened. To positions located in between the knob 41 and the supporting member 18, at the approximately central part of the lever 42, and at the rear end of the lever 42, disc portions 49, 43, 44 are fixed so as to jut in the radial direction of the lever 42 to be shaped like a disc. The diameter of the disc portions 49, 43, 44 is larger than that of the penetrating holes 18*a*, 19*a*. In FIG. 2A, the disc portion 49 abuts on the supporting member 18. In between the disc portion 44 and the supporting member 19, a coil spring 45 passes through the lever 42 so that the both ends of the coil spring 45 abuts on the supporting member 19 and the disc portion 44.

Figure 2B:
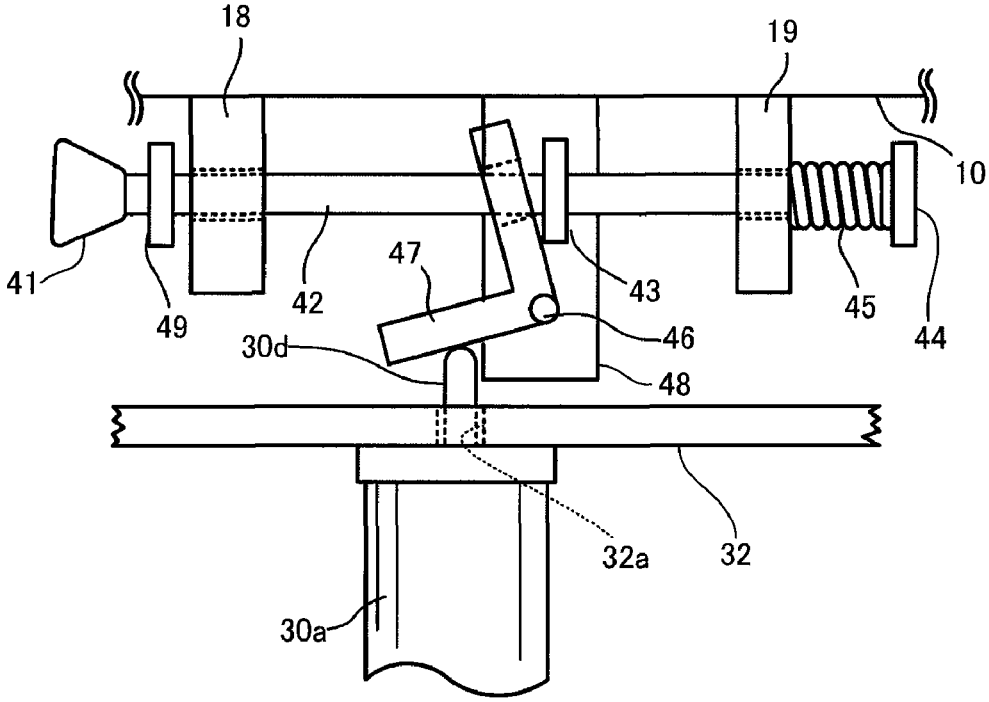

An L-shaped plate 47 is formed by longitudinally bending a long rectangular metal plate in the shape of the letter L. The L-shaped plate 47 extends below the main body 10 in the horizontal direction. The L-shaped plate 47 is rotatably supported about a rotational axis 46 which is shown as perpendicular to the surface of the paper. A pair of axis supporting portions 48 juts from the undersurface of the main body 10 to fix the rotational axis 46 to the main body 10. The pair of axis supporting portions 48 is provided so as to sandwich the L-shaped plate 47. In FIG. 2A and FIG. 2B, however, only the left axis supporting portion 48 is shown. The L-shaped plate 47 may be configured to be urged about the rotational axis 46 by a coil spring or the like which is not shown in a clockwise direction.

On the L-shaped plate 47, a penetrating hole 47*a* whose diameter is smaller than that of the disc portion 43 is provided so that the lever 42 penetrates through the penetrating hole 47*a* at the front (left side in the figure) of the disc portion 43. The penetrating hole 47*a* may be a notch having an aperture which is smaller than the disc portion 43. The top end of the cylinder portion 30*a* of the gas cylinder 30 is fixed to a surface of the flange portion 32, the surface being parallel to the floor. As a result, the main body 10 is supported by the gas cylinder 30 through the flange portion 32. At the center of the top end of the cylinder portion 30*a*, a gas control pin 30*d* is provided in order to allow control of stroke of the cylinder by depression of the gas control pin 30*d*. The gas control pin 30*d* penetrates through a penetrating hole 32*a* provided on the flange portion 32 to jut upward with the top end of the gas control pin 30*d* abutting on the undersurface of the L-shaped plate 47.

In the above-described configuration, FIG. 2B shows a state where a user holding the knob 41 pulls the knob 41 toward him. In the shown state, the coil spring 45 sandwiched between the disc portion 44 and the supporting member 19 is contracted. Being pressed by the disc portion 43, the L-shaped plate 47 turns about the rotational axis 46 in a counterclockwise direction to depress the gas control pins 30*d* of the pair of gas cylinders 30 provided on both sides. As a result, the gas cylinders 30 become extendable and contractible. If the user adjusts the main body 10 to his desired height and then releases the knob 41, the gas cylinder operating portion 40 returns to its original state (FIG. 2A) due to springing force of the coil spring 45, resulting in the current height of the main body 10 being fixed.

1.3 Detailed Configuration of Pedal Unit 50

Figure 3B:
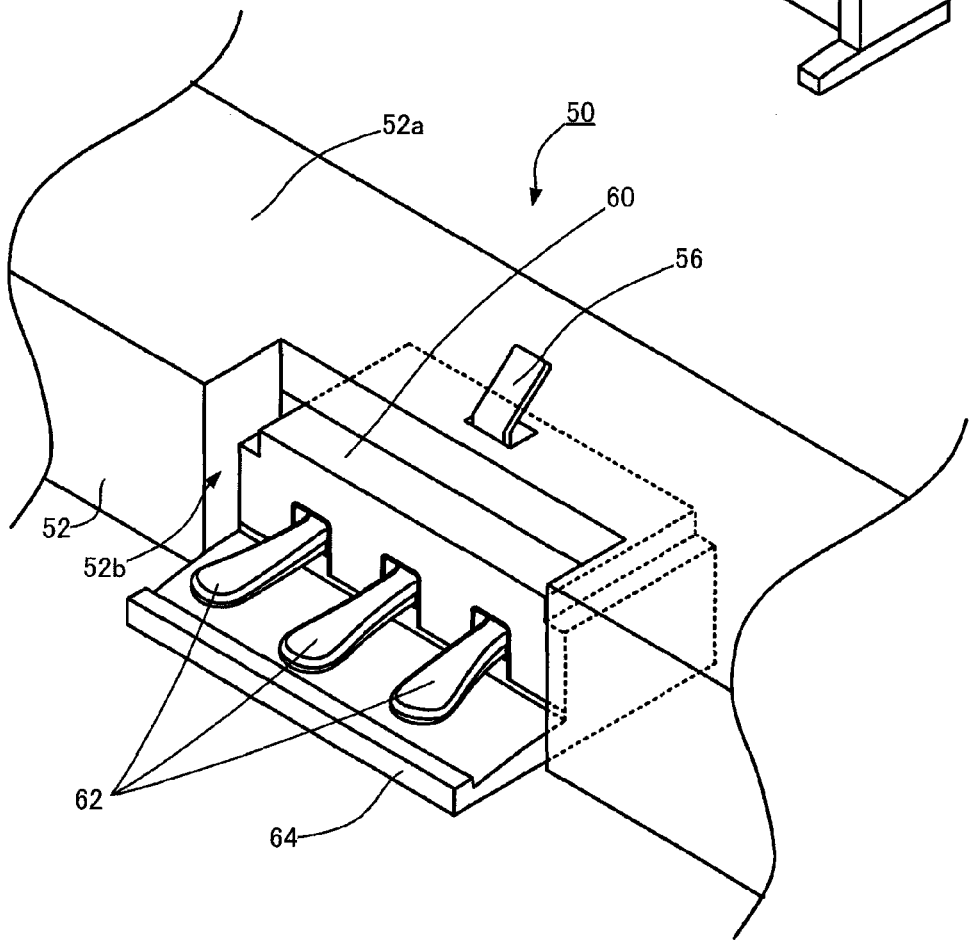

Detailed configuration of the pedal unit 50 will be described with reference to FIG. 3B. As described above, the pedal unit 50 is formed of the fixed unit 52 and a moving unit 60. The fixed unit 52 is approximately rectangular parallelepiped to be shaped like a box with its front central portion 52*b* being open and the front central part of an upper plate 52*a* being notched. From the open portions, the moving unit 60 is exposed. From the front surface of the moving unit 60, a plurality of pedals operated by a user's foot (e.g., damper, soft, sostenuto) 62, . . . , 62 jut. Below the pedals, a supporting leg 64 which serves as a stopper of the pedals and as a handle held by the user when he desires to move the moving unit 60 is provided. On a central portion of the upper plate 52*a* of the fixed unit 52, a lever 56 which is operated by the user is provided.

Figure 4:
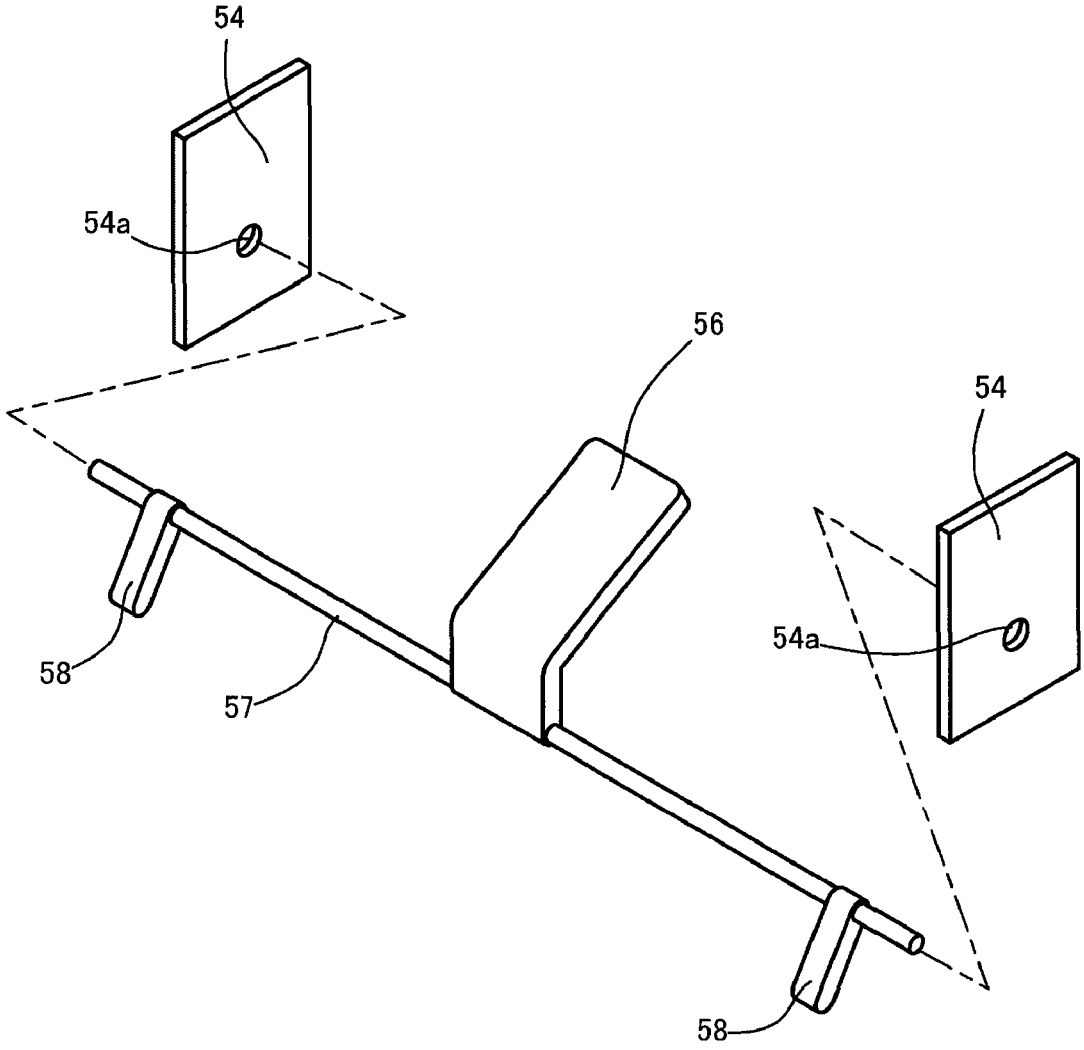
FIG. 4 is a perspective view of a lever 56 and related members.

Next, detailed configuration of the lever 56 and related members will be described with reference to FIG. 4. The lever 56 is formed by bending an approximately rectangular metal plate to about "120°". To one end of the lever 56, a long cylindrical metal rod 57 is secured. To positions located slightly inward from the both ends of the metal rod 57, nails 58, 58 which are metal plates shaped like an approximately rectangular plate are fixed. Lever supporting portions 54, 54, which are shaped like an approximately rectangular plate, jut downward from the upper plate 52*a* of the fixed unit (see FIG. 3B). The lever supporting portions 54, 54 may be formed integrally with the upper plate 52*a*. Alternatively, the lever supporting portions 54, 54 may be formed separately from the upper plate 52*a* to be fixed to the upper plate 52*a*. On the lever supporting portions 54, 54, circular penetrating holes 54*a*, 54*a* are formed. Through the penetrating holes 54*a*, 54*a*, end portions of the metal rod 57 rotatably penetrate. As a result, the lever 56 is allowed to rotate about the metal rod 57, with the nails 58, 58 rotating in synchronization with the lever 56. The lever 56 may be formed integrally with the metal rod 57 by bending a central portion of the metal rod 57 to be shaped like the letter U.

Figure 5A:
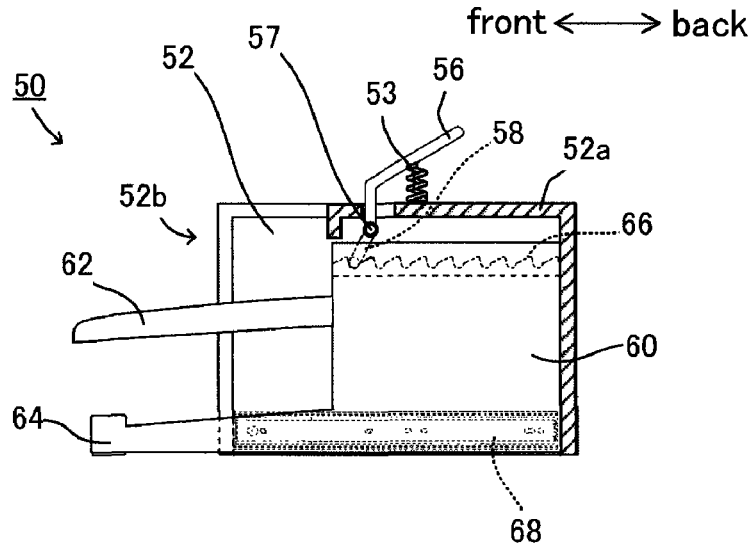
FIG. 5A, FIG. 5B and FIG. 5C are diagrams illustrating operation of a pedal unit 50.
Figure 5B:
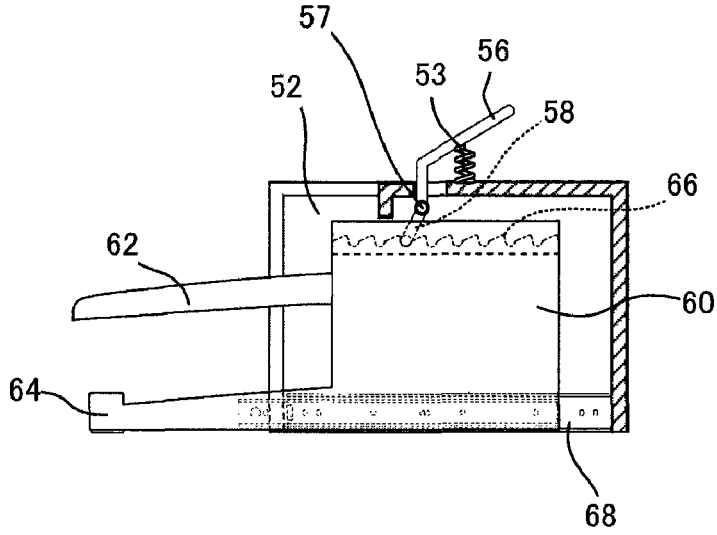
Figure 5C:
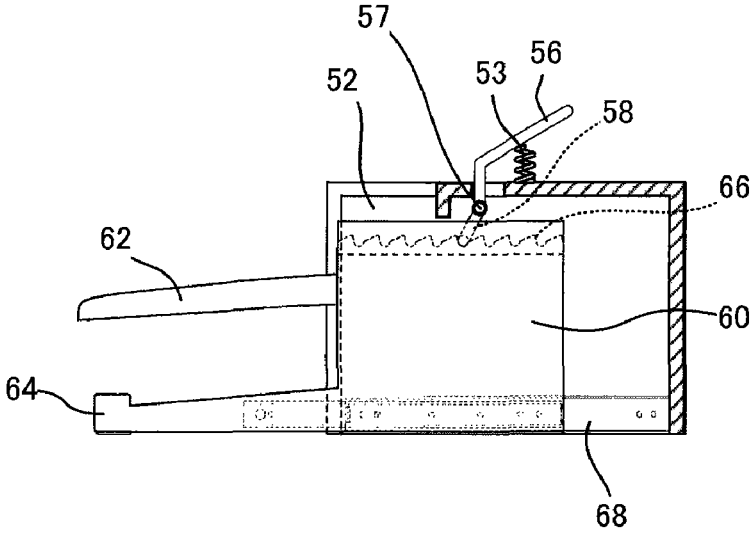

Next, the internal structure of the pedal unit 50 will be explained. In FIG. 5A, a slide rail 68, which is mounted between the moving unit 60 and the fixed unit 52, guides the moving unit 60 so that the moving unit 60 can slide in a front-back direction. Because the metal rod 57 is rotatably supported by the lever supporting portions 54, 54 (see FIG. 4) as described above, the lever 56 is allowed to turn about a rotational axis which is perpendicular to the surface of the paper, the rotational axis being provided on the metal rod 57 in the figure. A coil spring 53, which is provided between the upper plate 52*a* and the lever 56, urges the lever 56 in a counterclockwise direction. The upper portion of the lever 56 juts upward from a hole provided on the upper plate 52*a*. The rotation of the lever 56 in a counterclockwise direction urged by the coil spring 53 is always restricted by the front side of the edge of the hole. Only a small amount of rotation of the lever 56 in a clockwise direction is allowed in spite of urging power exerted by the coil spring 53. Below the lever 56, racks 66 formed of a sawtooth resin are fastened to the both sides of the moving unit 60. In FIG. 5A to FIG. 5C, however, only the rack 66 which is provided on the left side is shown. Each tooth forming the rack 66 is gently inclined from the top of the tooth to the front (to the left in the figure), while each tooth is steeply inclined to the rear. The lower end of the nail 58 is inserted between two of the "teeth", so that the nail 58 and the rack 66 results in a ratchet mechanism in collaboration with the coil spring 53 and the upper plate 52*a*. More specifically, if the user holds the supporting leg 64 or the like and then pulls the moving unit 60 frontward, the nail 58 easily hurdles the respective "teeth" of the rack 66 with a small amount of rotation of the lever 56 in a clockwise direction being allowed. As shown in FIG. 5B and FIG. 5C, as a result, the moving unit 60 is moved frontward by a small amount of power without resistance by the ratchet mechanism. The position of the moving unit 60 is determined by the ratchet mechanism.

If the user tries to push the moving unit 60 backward as it is, the nail 58 is engaged in the rack 66 with rotation of the lever 56 in a counterclockwise direction being restricted by the upper plate 52*a*. As a result, the backward move of the moving unit 60 is restricted. In this case, if the user tilts the lever 56 backward in spite of urging power of the coil spring 53 to release the nail 58 from the rack 66, the user is allowed to move the moving unit 60 backward without resistance. In the first embodiment, as described above, the frontward move of the moving unit 60 is not particularly restricted, but only the backward move of the moving unit 60 is restricted. Next, the reason of the restriction will be described. If the user operates the pedals 62, . . . , 62, forces which press the moving unit 60 not only upward and downward but also backward act. Unless the backward move is restricted, therefore, a problem that the moving unit 60 gradually moves backward will arise. If the pedals 62, . . . , 62 are operated in a normal way, any force which pulls the moving unit 60 frontward will not act. Therefore, there is little necessity to restrict the frontward move of the moving unit 60.

2. Second Embodiment

Figure 6:
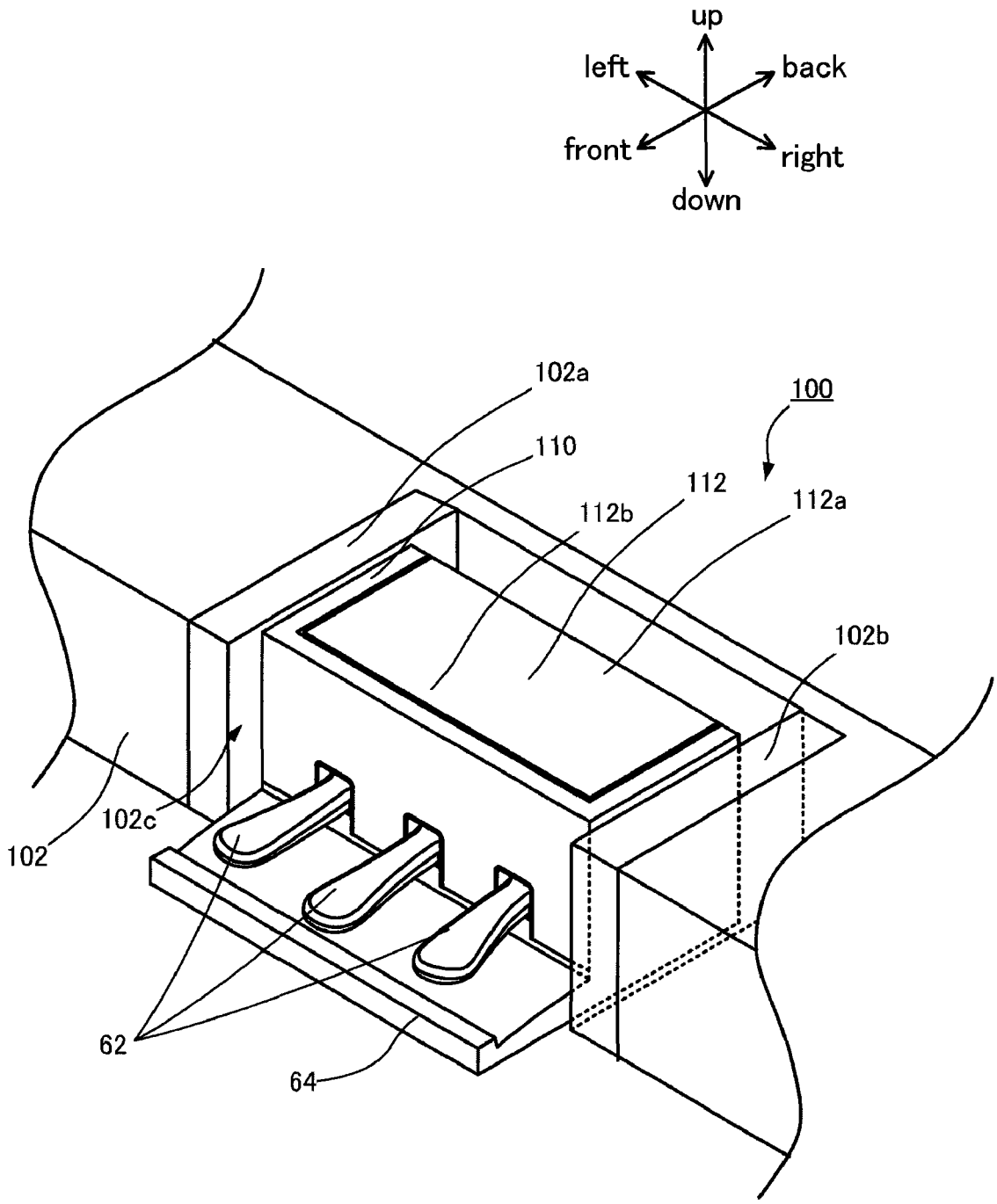
FIG. 6 is a perspective view of a pedal unit 100 employed in a second embodiment.

Next, configuration of an electronic keyboard instrument of a second embodiment of the present invention will be described. Although the general configuration of the second embodiment is almost the same as that of the first embodiment (FIG. 1), the second embodiment employs a pedal unit 100 shown in FIG. 6 instead of the pedal unit 50 employed in the first embodiment. In FIG. 6, the pedal unit 100 is formed of a fixed unit 102 and a moving unit 110. The fixed unit 102 is approximately rectangular parallelepiped to be shaped like a box. At the central portion of the fixed unit 102, a notch portion 102*c* which is notched to have a concavity is formed. The moving unit 110 is inserted in the notch portion 102*c*.

From the moving unit 110, as in the case of the moving unit 60 of the first embodiment, the supporting leg 64 and the pedals 62, . . . , 62 jut frontward. Into the upper surface of the moving unit 110, a rectangular movable top plate 112 is fit. A rear end 112*a* of the movable top plate 112 is pivotally supported by the moving unit 110 itself, so that a front end 112*b* of the movable top plate 112 is allowed to sink downward.

The fixed unit 102 is provided with a left side plate 102*a* and a right side plate 102*b* on positions which are opposed to both side surfaces of the moving unit 110. Detailed configuration of the left side plate 102*a* will be described with reference to FIG. 7A. On an internal surface of the left side plate 102*a*, a concave portion 104 which is dented to have a rectangle in a front-back direction is formed. From the top surface of the concave portion 104, a rack 106 formed of a sawtooth resin juts downward. Each tooth forming the rack 106 is gently inclined from the top (lower end) of the tooth to the rear, while each tooth is steeply inclined to the front. An angle 115 is mounted on the undersurface of the movable top plate 112 of the moving unit 110. From the angle 115, an approximately cylindrical pin 114 juts toward the concave portion 104.

Figure 7A:
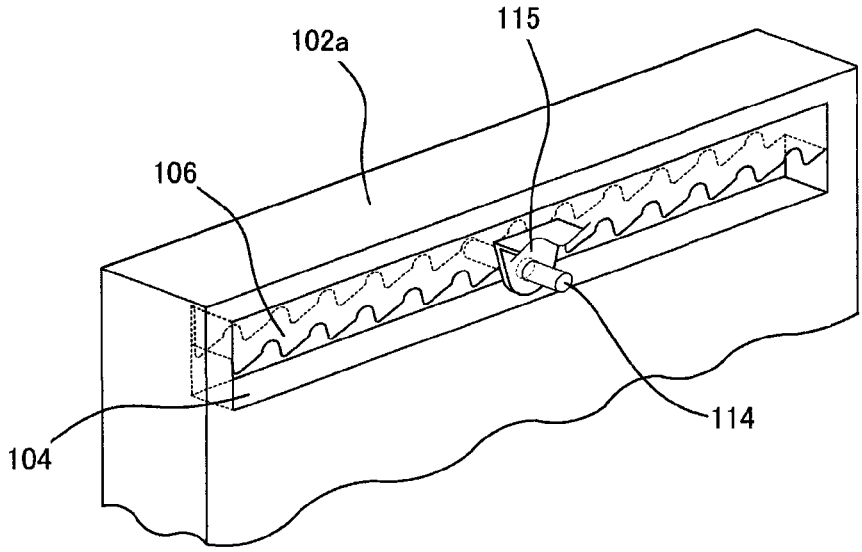
FIG. 7A, FIG. 7B, FIG. 7C and FIG. 7D are diagrams illustrating configuration of respective parts of the pedal unit 100.
Figure 7B:
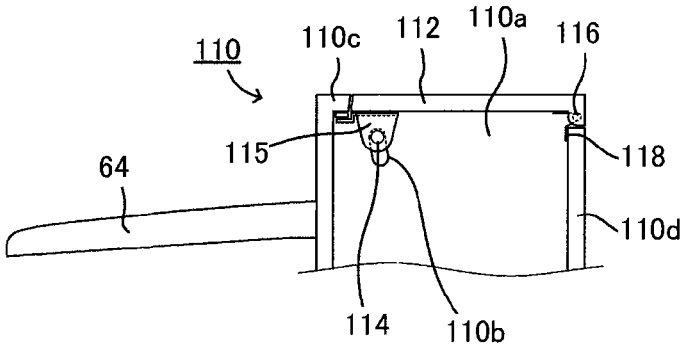
Figure 7C:
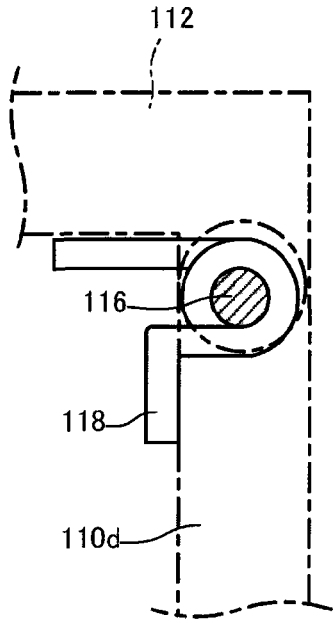

Next, an internal structure of the moving unit 110 will be described. In FIG. 7B, the movable top plate 112 is allowed to turn about an axis 116 fixed to a back plate 110*d* of the moving unit 110. Through the axis 116, a coil spring 118 shown in FIG. 7C is pierced. The coil spring 118 urges the movable top plate 112 and the back plate 110*d* to open up the movable top plate 112 and the back plate 110*d*. The top end of a front plate 110*c* of the moving unit 110 is slightly bent to about "90°" backward. The angle 115 fixed to the undersurface of the front portion of the movable top plate 112 juts below the bent portion of the front plate 110*c*.

As a result, although the coil spring 118 applies a force which causes the movable top plate 112 to turn in a clockwise direction to the movable top plate 112, the angle 115 is locked by the front plate 110*c*, resulting in the movable top plate 112 remaining in a horizontal position as shown in the figure. On a left side plate 110*a* of the moving unit 110, a long penetrating hole 110*b* is formed along a direction in which the pin 114 turns. From the penetrating hole 110*b*, the pin 114 is exposed toward the left side plate 102*a* of the fixed unit 102. Although descriptions about the concave portion 104, the rack 106, the pin 114, the angle 115 and the penetrating hole 110*b* provided for the left side plate 102*a* and the left side of the fixed unit 102 have been given, a similar structure is provided for the right side plate 102*b* and the right side of the fixed unit 102 to obtain symmetry.

Figure 8A:
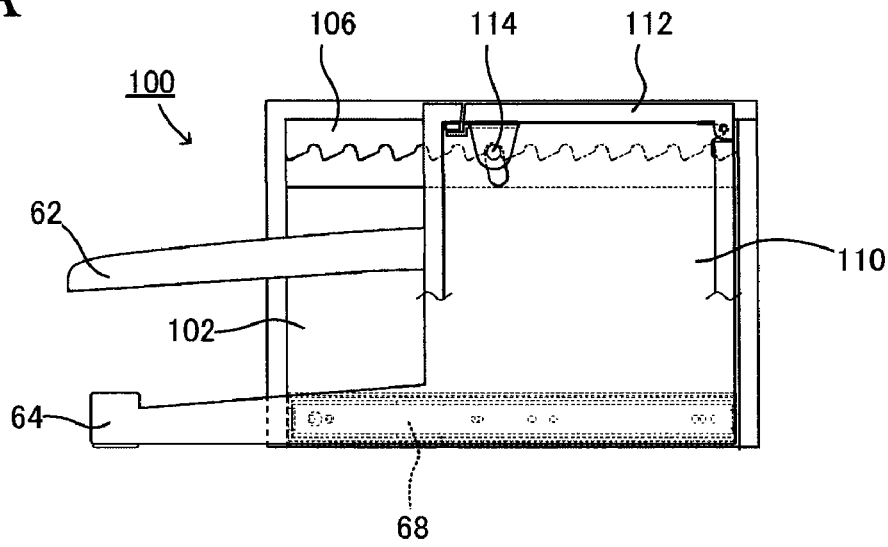
FIG. 8A, FIG. 8B and FIG. 8C are diagrams illustrating operation of the pedal unit 100.
Figure 8B:
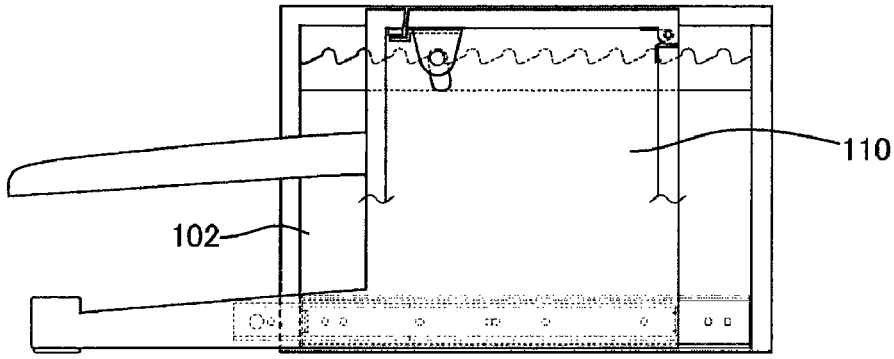
Figure 8C:
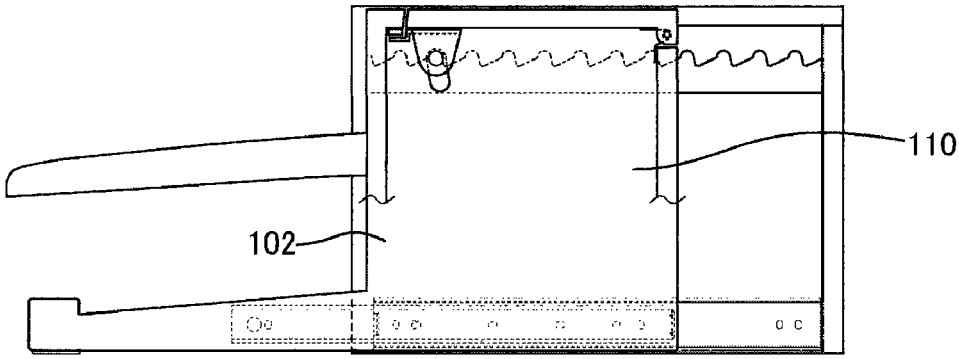

In FIG. 8A, the slide rail 68 is mounted between the moving unit 110 and the fixed unit 102, as in the case of the first embodiment. As a result, the moving unit 110 can slide in a front-back direction. In FIG. 7A, the pin 114 is inserted between two of the "teeth" which configure the rack 106, so that the pin 114 and the rack 106 results in a ratchet mechanism in collaboration with the coil spring 118, the angle 115 and the front plate 110*c*. Similarly to the first embodiment, more specifically, if the user holds the supporting leg 64 or the like and then pulls the moving unit 110 frontward, the pin 114 easily hurdles the respective "teeth" of the rack 106 with a small amount of downward displacement of the pin 114 and the movable top plate 112 being allowed. As shown in FIG. 8B and FIG. 8C, as a result, the moving unit 110 is moved frontward by a small amount of power without resistance by the ratchet mechanism. The position of the moving unit 110 is determined by the ratchet mechanism.

Figure 7D:
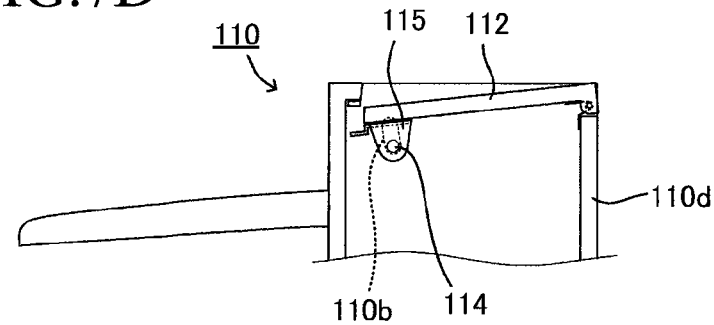

If the user tries to push the moving unit 110 backward as it is, the pin 114 is engaged in the rack 106 with upward displacement of the pin 114 and the movable top plate 112 being restricted by the front plate 110*c*. As a result, the backward move of the moving unit 110 is restricted. In this case, the user is required to depress the front end of the movable top plate 112 as shown in FIG. 7D. As a result, the pin 114 is released from the rack 106, so that the user is allowed to move the moving unit 110 backward without resistance. In the second embodiment, similarly to the first embodiment, as described above, the frontward move of the moving unit 110 is not particularly restricted, but only the backward move of the moving unit 110 is restricted.

A further feature of the second embodiment is that the user is allowed to adjust the position of the moving unit 110 only with his "foot". If the user depresses the movable top plate 112 with his foot and then moves his foot frontward or backward, more specifically, the moving unit 110 moves frontward or backward with a small amount of force without resistance by the ratchet mechanism. If the user then releases his foot from the movable top plate 112 at a desired position, the further backward move of the moving unit 110 is restricted by the ratchet mechanism. According to the second embodiment, therefore, there is no need for the user to crawl under the main body 10, resulting in further easy adjustment of the position of the moving unit 110.

3. Third Embodiment

Figure 9:
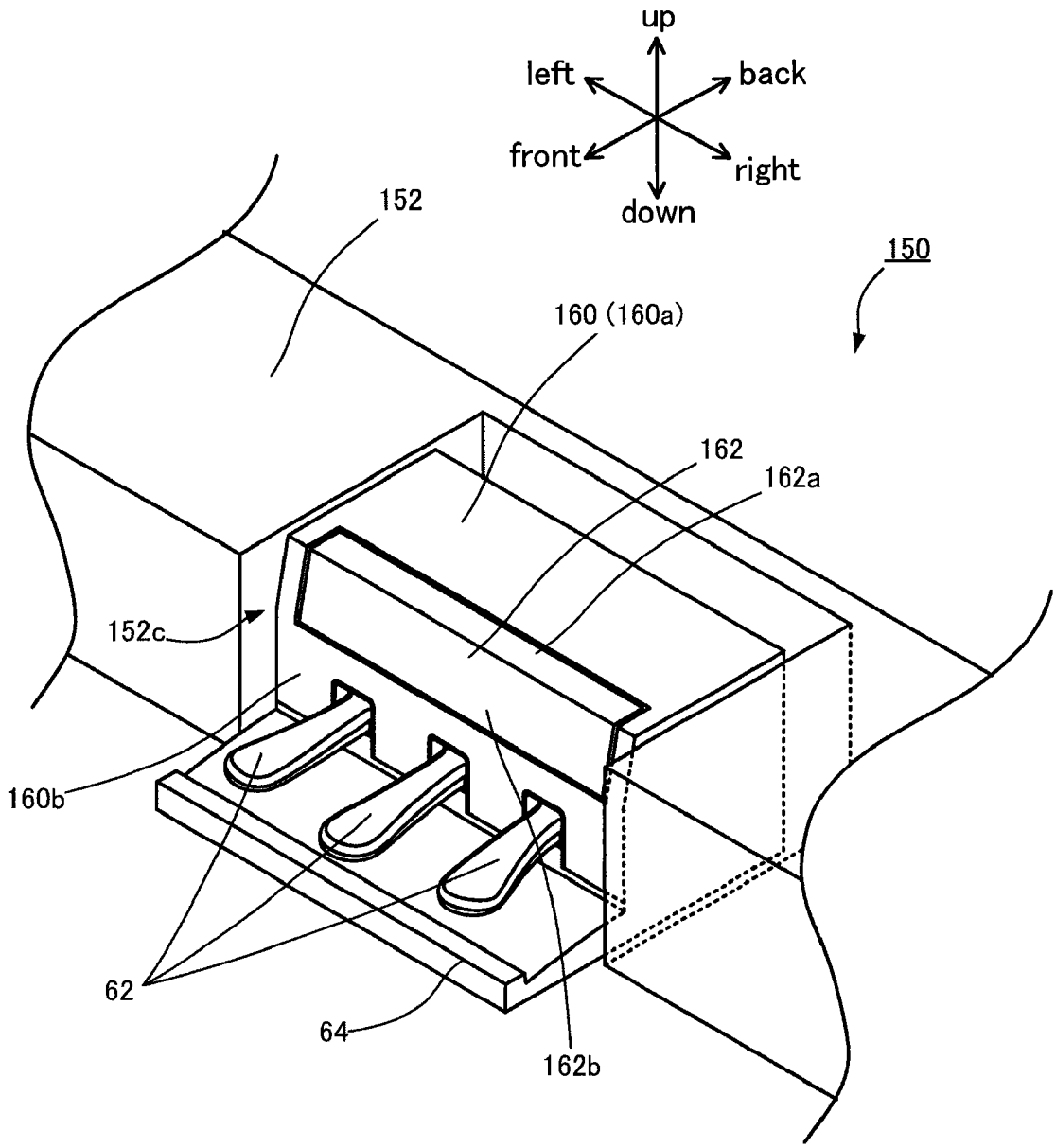
FIG. 9 is a perspective view of a pedal unit 150 employed in a third embodiment.

Next, configuration of an electronic keyboard instrument of a third embodiment of the present invention will be described. Although the general configuration of the third embodiment is almost the same as that of the first embodiment (FIG. 1), the third embodiment employs a pedal unit 150 shown in FIG. 9 instead of the pedal unit 50 employed in the first embodiment. In FIG. 9, the pedal unit 150 is formed of a fixed unit 152 and a moving unit 160. The fixed unit 152 is approximately rectangular parallelepiped to be shaped like a box. At the central portion of the fixed unit 152, a notch portion 152*c* which is notched to have a concavity is formed. The moving unit 160 is inserted in the notch portion 152*c*.

From the moving unit 160, as in the case of the moving unit 60 of the first embodiment, the supporting leg 64 and the pedals 62, . . . , 62 jut frontward. As for the moving unit 160, a front portion of a top plate 160*a* and an upper portion of a front plate 160*b* are notched, so that a movable plate 162 having a cross-section approximately shaped like a letter "L" is inserted into the notch. A rear end 162*a* of the movable plate 162 is pivotally supported by the moving unit 160 itself, so that a front end 162*b* of the movable plate 162 is allowed to turn in an inward direction.

Figure 10A:
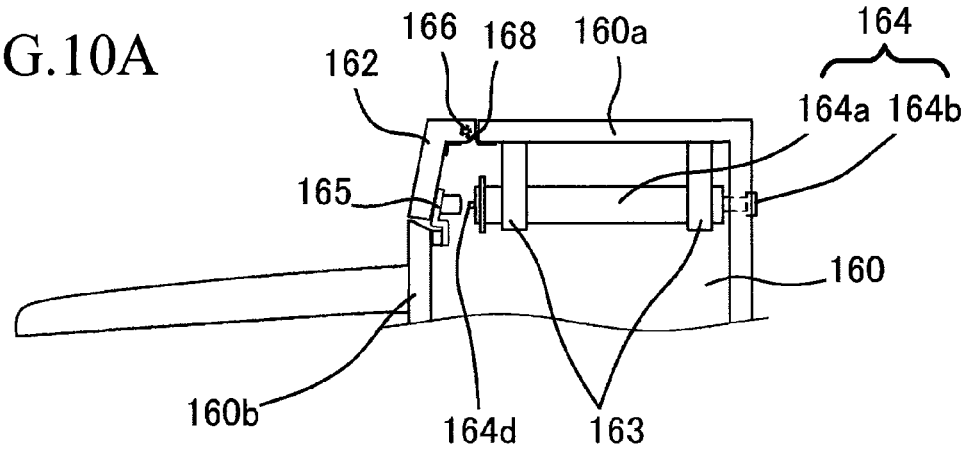
FIG. 10A, FIG. 10B and FIG. 10C are diagrams illustrating configuration of respective parts of the pedal unit 150.
Figure 10B:
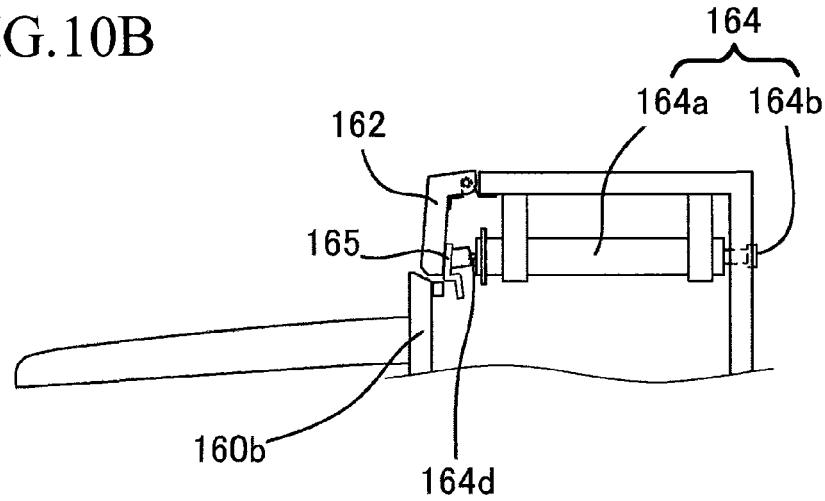
Figure 10C:
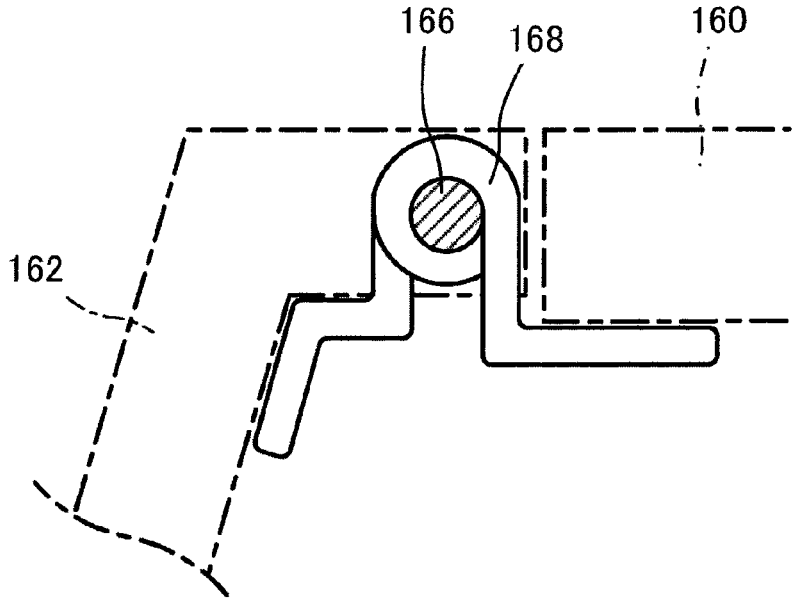

Next, an internal structure of the moving unit 160 will be described. In FIG.10A, the movable plate 162 is allowed to turn about an axis 166 fixed to the top plate 160*a*. Through the axis 166, a coil spring 168 shown in FIG. 10C is pierced. The coil spring 168 urges the movable plate 162 and the top plate 160*a* to open up the movable plate 162 and the top plate 160*a*. An angle 165 fixed to the lower end of the movable plate 162 juts toward the inside of the front panel 160*b*.

As a result, although the coil spring 168 applies a force which causes the movable plate 162 to turn in a clockwise direction to the movable plate 162, the angle 165 is locked by the front plate 160*b*, resulting in the movable plate 162 remaining in a position shown in FIG. 10A. A gas cylinder 164 is formed of an approximately tubular cylinder portion 164*a* and an approximately cylindrical piston portion 164*b* jutting backward from the cylinder portion 164*a*. The rear end of the piston portion 164*b* is fixed to a back plate of the fixed unit 152. From the front end of the cylinder portion 164*a*, a gas control pin 164*d* which allows control of stroke of the cylinder by depression of the gas control pin 164*d* juts. In the gas cylinder 164 as well, the piston portion 164*b* is continuously urged by inner gas pressure of the cylinder portion 164*a* to protrude from the cylinder portion 164*a*. The gas cylinder 164 also allows move of gas contained in the cylinder portion 164*a* during depression of the gas control pin 164*d*, so that the piston portion 164*b* can get into or out of the cylinder portion 164*a*. As a result, more specifically, the length of the gas cylinder 164 is variable. If the depression of the gas control pin 164*d* is released, the gas cylinder 164 prohibits move of the gas contained in the cylinder portion 164*a* to prohibit relative move of the piston portion 164*b* with respect to the cylinder portion 164*a*. A gas cylinder supporting portion 163 is provided in order to fix the cylinder portion 164*a* of the gas cylinder 164 to the shown position.

Figure 11A:
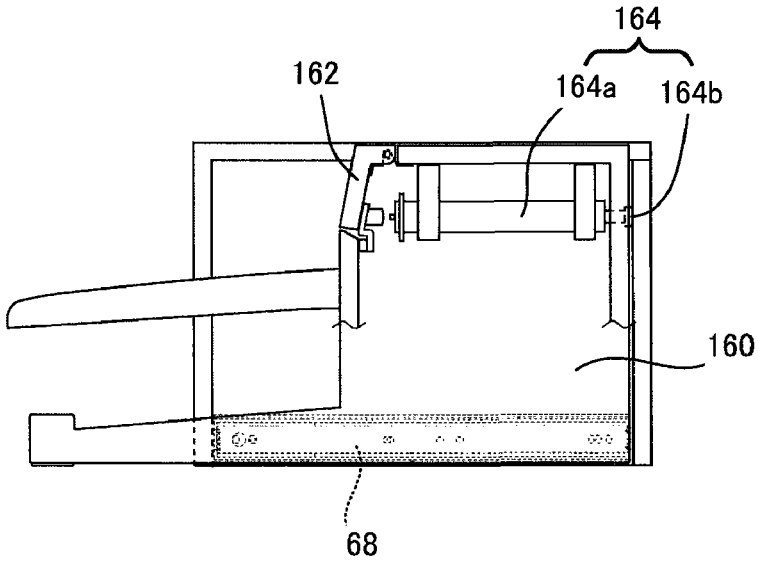
FIG. 11A, FIG. 11B and FIG. 11C are diagrams illustrating operation of the pedal unit 150.

In FIG. 11A, the slide rail 68 is mounted between the moving unit 160 and the fixed unit 152, as in the case of the first embodiment. As a result, the moving unit 160 can slide in a front-back direction. In FIG. 10B, if the user pushes the movable plate 162 to turn in a counterclockwise direction, the gas control pin 164*d* is pushed by the angle 165, so that the piston portion 164*b* is urged backward with the gas cylinder 164 becoming extendable and contractible.

Figure 11B:
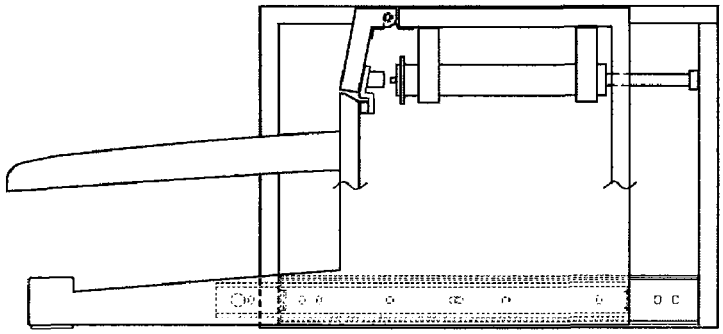
Figure 11C:
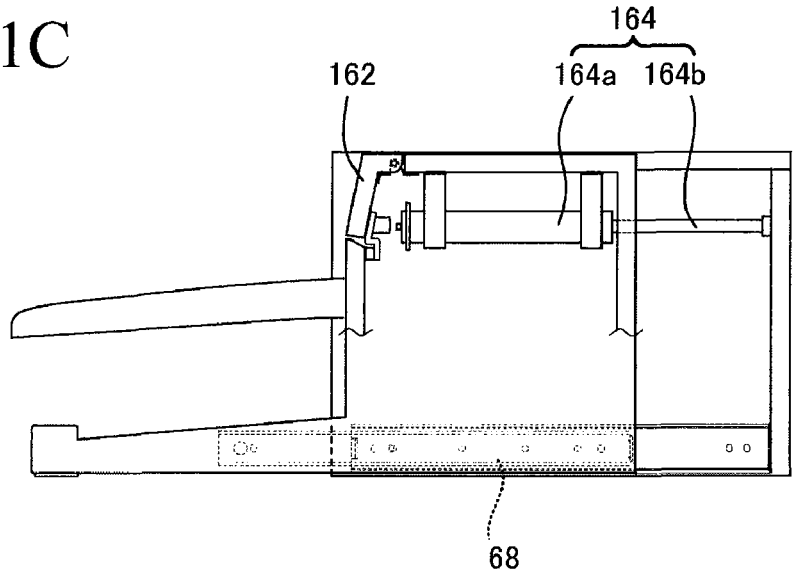

In a state where the user is lightly pressing the movable plate 162 with his foot, in other words, in a state where the user presses the movable plate 162 with a force which is equal to or more than a force required to manipulate the gas control pin 164*d* but is weaker than a force exerted by the piston portion 164*d*, the moving unit 160 is moved frontward by the force exerted by the piston portion 164*b*. In a state where the user is strongly pressing the movable plate 162, in other words, in a state where the user presses the movable plate 162 with a force stronger than a force exerted by the piston portion 164*b*, the moving unit 160 is moved backward in spite of the force exerted by the piston portion 164*b*. If the user adjusts the position of the moving unit 160 to his desired position and then releases his foot from the movable plate 162, as described above, the position of the moving unit 160 is fixed to the adjusted position. FIG. 11A to FIG. 11C show adjusted example positions of the moving unit 160.

Unlike the above-described first and second embodiments, both frontward move and backward move of the moving unit 160 are restricted in the third embodiment. According to the third embodiment, similarly to the second embodiment, the user is allowed to adjust the position of the moving unit 160 only with his "foot". As a result, there is no need for the user to crawl under the main body 10, resulting in easy adjustment of the position of the moving unit 160.

4. Modified Examples

The present invention is not limited to the above-described first to third embodiments, but may be modified variously as described below:

(1) Although the plurality of pedals 62, . . . , 62 such as damper, soft, sostenuto are mounted as an example of "pedal" on the above-described embodiments, the "pedal" is not limited to those described above but may be a pedal keyboard, expression pedal or the like. Alternatively, only a pedal may be mounted. Furthermore, the pedal unit is not limited to the one which can be divided into fixed/moving units as in the cases of the above-described embodiments. The pedal unit may be configured such that the pedal unit is not divided, so that the entire pedal unit can move frontward and backward and can be fixed with respect to the upper and lower stand portions 22, 24.

(2) Although the gas cylinder, the slide rail, and the ratchet mechanism and the like are described in the above-described embodiments as the means for allowing the main body to move upward and downward or to be fixed, and for allowing the pedal unit to move frontward and backward or to be fixed, the means for allowing the main body and the pedal unit to move upward and downward or frontward and backward or to be fixed is not limited to those described above. A screw mechanism in which a screw or a nut is turned to allow the main body or the pedal unit to move or a stepwise mounting mechanism realized by a plurality of screws and a plurality of mounting holes provided for position adjustment may be employed.

What is claimed is:

1. An electronic musical instrument comprising:

a stand portion for supporting a main body on both sides thereof, the main body having a keyboard operated with player's hands;

a fixed unit fixed to a lower end of the stand portion;

a moving unit, equipped with a pedal operated with a player's foot, the moving unit being mounted on the fixed unit so that the moving unit is movable frontward and backward with respect to the fixed unit;

an operating member; and a restricting mechanism that allows the moving unit to move frontward with respect to the fixed unit but prohibits the moving unit from moving backward with respect to the fixed unit while the operating member is not operated, and allows the moving unit to move both frontward and backward with respect to the fixed unit when the operating member is operated;

wherein the restricting mechanism includes a ratchet mechanism.

2. An electronic musical instrument according to claim 1 wherein the operating member is operated with a player's foot.

3. An electronic musical instrument according to claim 1 wherein the stand portion comprises a lower stand portion to which the fixed unit is fixed and an upper stand portion which supports the main body; and the upper stand portion is mounted on the lower stand portion so that the upper stand portion is movable upward and downward.

4. An electronic musical instrument according to claim 3 further comprising:

a second restricting mechanism that prohibits the upper stand portion from moving both upward and downward with respect to the lower stand portion while an operating member is not operated, and allows the upper stand portion to move both upward and downward with respect to the lower stand portion while the operating member is operated.

5. An electronic musical instrument according to claim 4 wherein the second restricting mechanism includes a gas cylinder apparatus.

6. An electronic musical instrument according to claim 1 wherein the moving unit comprises a supporting leg located under the pedal which serves as a stopper and as a handle by which the user can move the moving unit.

* * * * *